US008406450B2

(12) United States Patent
Jiang et al.

(10) Patent No.: US 8,406,450 B2
(45) Date of Patent: Mar. 26, 2013

(54) THERMOACOUSTIC DEVICE WITH HEAT DISSIPATING STRUCTURE

(75) Inventors: Kai-Li Jiang, Beijing (CN); Liang Liu, Beijing (CN); Chen Feng, Beijing (CN); Li Qian, Beijing (CN); Shou-Shan Fan, Beijing (CN)

(73) Assignees: Tsinghua University, Beijing (CN); Hon Hai Precision Industry Co., Ltd., New Taipei (TW)

( * ) Notice: Subject to any disclaimer, the term of this patent is extended or adjusted under 35 U.S.C. 154(b) by 416 days.

(21) Appl. No.: 12/768,059

(22) Filed: Apr. 27, 2010

(65) Prior Publication Data

US 2011/0051961 A1 Mar. 3, 2011

(30) Foreign Application Priority Data

Aug. 28, 2009 (CN) ..... 2009 1 0189916

(51) Int. Cl.
*H04R 1/28* (2006.01)
*H04R 1/20* (2006.01)
*H04R 1/42* (2006.01)

(52) U.S. Cl. ..... 381/397

(58) Field of Classification Search ..... 381/164, 381/397

See application file for complete search history.

(56) References Cited

U.S. PATENT DOCUMENTS

| | | | | |
|---|---|---|---|---|
| 1,528,774 | A | 3/1925 | Kranz | |
| 3,670,299 | A | 6/1972 | Kahn | |
| 3,982,143 | A | 9/1976 | Tamura et al. | |
| 3,991,286 | A * | 11/1976 | Henricksen | 381/189 |
| 4,002,897 | A | 1/1977 | Kleinman et al. | |
| 4,045,695 | A | 8/1977 | Itagaki et al. | |
| 4,210,778 | A * | 7/1980 | Sakurai et al. | 381/349 |
| 4,334,321 | A | 6/1982 | Edelman | |
| 4,503,564 | A | 3/1985 | Edelman et al. | |
| 4,641,377 | A | 2/1987 | Rush et al. | |
| 4,689,827 | A | 8/1987 | Gurney, Jr. | |
| 4,766,607 | A | 8/1988 | Feldman | |
| 5,694,477 | A | 12/1997 | Kole | |
| 5,792,999 | A * | 8/1998 | Arnold et al. | 181/141 |
| 5,894,524 | A * | 4/1999 | Kotsatos et al. | 381/397 |

(Continued)

FOREIGN PATENT DOCUMENTS

| | | |
|---|---|---|
| CN | 2083373 | 8/1991 |
| CN | 2251746 Y | 4/1997 |

(Continued)

OTHER PUBLICATIONS

Lin Xiao, Zhuo Chen, Chen Feng, Liang Liu et al., Flexible, Stretchable, Transparent Carbon Nanotube Thin Film Loudspeakers, Nano Letters, 2008, pp. 4539-4545, vol. 8, No. 12, US.

(Continued)

*Primary Examiner* — Edgardo San Martin
(74) *Attorney, Agent, or Firm* — Altis Law Group, Inc.

(57) ABSTRACT

A thermoacoustic device includes at least one first electrode, at least one second electrode, a thermoacoustic element, a base and a plurality of fins. The at least one second electrode is spaced from the at least one first electrode. The thermoacoustic element is electrically connected with the at least one first electrode and the at least one second electrode. The base supports the thermoacoustic element and the at least one first electrode and the at least one second electrode. The fins are in thermal engagement with the base.

20 Claims, 12 Drawing Sheets

U.S. PATENT DOCUMENTS 6,259,798 B1 * 7/2001 Perkins et al. ..... 381/397
6,307,300 B1 10/2001 Yamamoto et al.
6,473,625 B1 10/2002 Williams et al.
6,777,637 B2 8/2004 Nakayama et al.
6,803,116 B2 10/2004 Ikeda
6,803,840 B2 * 10/2004 Hunt et al. ..... 333/186
6,808,746 B1 10/2004 Dai et al.
6,864,668 B1 3/2005 McCune et al.
6,921,575 B2 7/2005 Horiuchi et al.
7,045,108 B2 5/2006 Jiang et al.
7,088,841 B2 * 8/2006 Kallen ..... 381/397
7,130,436 B1 10/2006 Tabata et al.
7,242,250 B2 7/2007 Tsurumi
7,315,204 B2 1/2008 Seven
7,366,318 B2 4/2008 Nevill
7,393,428 B2 7/2008 Huang et al.
7,474,590 B2 1/2009 Watabe et al.
7,572,165 B2 8/2009 Liu et al.
7,723,684 B1 5/2010 Haddon et al.
7,799,163 B1 9/2010 Mau et al.
7,804,976 B1 * 9/2010 Parham ..... 381/397
7,881,157 B2 * 2/2011 Watabe et al. ..... 367/140
7,965,156 B2 * 6/2011 Ward et al. ..... 333/186
8,014,555 B2 * 9/2011 Hyde et al. ..... 381/397
8,019,097 B2 * 9/2011 Jiang et al. ..... 381/164
8,019,098 B2 * 9/2011 Jiang et al. ..... 381/164
8,019,099 B2 * 9/2011 Jiang et al. ..... 381/164
8,019,100 B2 * 9/2011 Jiang et al. ..... 381/164
8,050,430 B2 * 11/2011 Jiang et al. ..... 381/164
8,050,431 B2 * 11/2011 Jiang et al. ..... 381/164
8,059,841 B2 * 11/2011 Jiang et al. ..... 381/164
8,059,856 B2 * 11/2011 Avera ..... 381/397
8,068,624 B2 * 11/2011 Jiang et al. ..... 381/164
8,068,625 B2 * 11/2011 Jiang et al. ..... 381/164
8,068,626 B2 * 11/2011 Jiang et al. ..... 381/164
8,073,163 B2 * 12/2011 Jiang et al. ..... 381/164
8,073,164 B2 * 12/2011 Jiang et al. ..... 381/164
8,073,165 B2 * 12/2011 Jiang et al. ..... 381/164
8,199,938 B2 * 6/2012 Jiang et al. ..... 381/164
8,208,661 B2 * 6/2012 Jiang et al. ..... 381/164
8,208,675 B2 * 6/2012 Jiang et al. ..... 381/386
2001/0005272 A1 6/2001 Buchholz
2001/0048256 A1 12/2001 Miyazaki et al.
2002/0076070 A1 6/2002 Yoshikawa et al.
2003/0038925 A1 2/2003 Choi
2003/0152238 A1 8/2003 Daly
2003/0165249 A1 9/2003 Higuchi
2004/0035558 A1 * 2/2004 Todd et al. ..... 165/104.26
2004/0053780 A1 3/2004 Jiang et al.
2004/0070326 A1 4/2004 Mao et al.
2004/0119062 A1 6/2004 Lu et al.
2005/0006801 A1 1/2005 Kinloch et al.
2005/0036905 A1 2/2005 Gokturk
2005/0040371 A1 2/2005 Watanabe et al.
2005/0201575 A1 9/2005 Koshida et al.
2006/0072770 A1 4/2006 Miyazaki
2006/0104451 A1 5/2006 Browning et al.
2006/0147081 A1 7/2006 Mango, III et al.
2006/0181848 A1 * 8/2006 Kiley et al. ..... 361/697
2006/0264717 A1 11/2006 Pesach et al.
2007/0145335 A1 6/2007 Anazawa
2007/0161263 A1 7/2007 Meisner
2007/0164632 A1 7/2007 Adachi et al.
2007/0166223 A1 7/2007 Jiang et al.
2007/0176498 A1 8/2007 Sugiura et al.
2008/0063860 A1 3/2008 Song et al.
2008/0095694 A1 4/2008 Nakayama et al.
2008/0170982 A1 7/2008 Zhang et al.
2008/0248235 A1 10/2008 Feng et al.
2008/0251723 A1 * 10/2008 Ward et al. ..... 250/338.4
2008/0260188 A1 10/2008 Kim
2008/0299031 A1 12/2008 Liu et al.
2008/0304201 A1 12/2008 Takao et al.
2009/0016951 A1 1/2009 Kawabata et al.
2009/0028002 A1 1/2009 Sugiura et al.
2009/0045005 A1 2/2009 Byon et al.
2009/0085461 A1 4/2009 Feng et al.
2009/0096346 A1 4/2009 Liu et al.
2009/0096348 A1 4/2009 Liu et al.
2009/0135594 A1 * 5/2009 Yu et al. ..... 362/234
2009/0145686 A1 6/2009 Watabe et al.
2009/0153012 A1 6/2009 Liu et al.
2009/0167136 A1 7/2009 Liu et al.
2009/0167137 A1 7/2009 Liu et al.
2009/0196981 A1 8/2009 Liu et al.
2009/0232336 A1 9/2009 Pahl
2009/0268557 A1 10/2009 Jiang et al.
2009/0268562 A1 10/2009 Jiang et al.
2009/0268563 A1 * 10/2009 Jiang et al. ..... 367/140
2009/0296528 A1 * 12/2009 Jiang et al. ..... 367/140
2010/0020494 A1 * 1/2010 Guo et al. ..... 361/696
2010/0046774 A1 * 2/2010 Feng et al. ..... 381/164
2010/0054502 A1 3/2010 Miyachi
2010/0054504 A1 * 3/2010 Jiang et al. ..... 381/164
2010/0054507 A1 3/2010 Oh et al.
2010/0086150 A1 * 4/2010 Jiang et al. ..... 381/164
2010/0086166 A1 4/2010 Jiang et al.
2010/0110839 A1 * 5/2010 Jiang et al. ..... 367/140
2010/0166231 A1 * 7/2010 Jiang et al. ..... 381/150
2010/0166232 A1 7/2010 Liu et al.
2010/0166233 A1 * 7/2010 Liu ..... 381/164
2010/0166234 A1 * 7/2010 Liu ..... 381/164
2010/0172213 A1 * 7/2010 Qian et al. ..... 367/140
2010/0172214 A1 * 7/2010 Qian et al. ..... 367/140
2010/0172215 A1 * 7/2010 Liu et al. ..... 367/140
2010/0172216 A1 * 7/2010 Liu et al. ..... 367/140
2010/0175243 A1 * 7/2010 Liu et al. ..... 29/594
2010/0188933 A1 * 7/2010 Qian et al. ..... 367/140
2010/0188934 A1 * 7/2010 Qian et al. ..... 367/140
2010/0188935 A1 * 7/2010 Qian et al. ..... 367/140
2010/0189296 A1 * 7/2010 Qian et al. ..... 381/345
2010/0195849 A1 * 8/2010 Qian et al. ..... 381/120
2010/0233472 A1 9/2010 Liu et al.
2010/0260357 A1 * 10/2010 Liu et al. ..... 381/164
2010/0260358 A1 * 10/2010 Liu ..... 381/164
2010/0260359 A1 * 10/2010 Liu ..... 381/164
2010/0311002 A1 * 12/2010 Jiang et al. ..... 432/227
2011/0033069 A1 * 2/2011 Liu et al. ..... 381/164
2011/0103621 A1 * 5/2011 Lutz ..... 381/164
2011/0110196 A1 * 5/2011 Liu ..... 367/140
2011/0110535 A1 * 5/2011 Jiang et al. ..... 381/111
2011/0158446 A1 * 6/2011 Liu et al. ..... 381/338
2011/0171419 A1 7/2011 Li et al.
2011/0216921 A1 * 9/2011 Tseng et al. ..... 381/164
2011/0255697 A1 * 10/2011 Qian et al. ..... 381/17
2011/0255717 A1 * 10/2011 Qian et al. ..... 381/182
2011/0274297 A1 * 11/2011 Wang et al. ..... 381/164
2011/0317866 A1 * 12/2011 Wang et al. ..... 381/394

FOREIGN PATENT DOCUMENTS

CN 2282750 Y 5/1998
CN 2302622 12/1998
CN 2327142 6/1999
CN 1239394 12/1999
CN 1265000 8/2000
CN 2425468 3/2001
CN 2485699 Y 4/2002
CN 1407392 4/2003
CN 1443021 9/2003
CN 1691246 11/2005
CN 1698400 11/2005
CN 1698400 A 11/2005
CN 1711620 A 12/2005
CN 2779422 Y 5/2006
CN 1787696 6/2006
CN 2787870 6/2006
CN 2798479 7/2006
CN 1821048 8/2006
CN 1886820 12/2006
CN 1944829 4/2007
CN 1982209 6/2007
CN 1997243 7/2007
CN 101239712 8/2008
CN 101284662 10/2008
CN 201150134 11/2008
CN 101314464 12/2008
CN 101437663 5/2009

| | | | |
|---|---|---|---|
| CN | 101458221 | A | 6/2009 |
| CN | 101471213 | | 7/2009 |
| CN | 101715155 | | 5/2010 |
| CN | 101400198 | | 9/2010 |
| DE | 102005059270 | | 6/2007 |
| JP | 49-24593 | | 3/1974 |
| JP | 58-9822 | | 1/1983 |
| JP | 58-19491 | | 2/1983 |
| JP | 60-22900 | | 2/1985 |
| JP | 61-294786 | | 12/1986 |
| JP | 1-255398 | | 10/1989 |
| JP | 3-147497 | | 6/1991 |
| JP | 4-126489 | | 4/1992 |
| JP | 6-33390 | | 4/1994 |
| JP | 7-282961 | | 10/1995 |
| JP | 8-20868 | | 1/1996 |
| JP | 9-105788 | | 4/1997 |
| JP | 11-282473 | | 10/1999 |
| JP | 11-300274 | | 11/1999 |
| JP | 2001333493 | | 11/2001 |
| JP | 2002-186097 | | 6/2002 |
| JP | 2002-352940 | | 12/2002 |
| JP | 2002346996 | | 12/2002 |
| JP | 2002542136 | | 12/2002 |
| JP | 2003500325 | | 1/2003 |
| JP | 2003-154312 | | 5/2003 |
| JP | 2003198281 | | 7/2003 |
| JP | 2003-266399 | | 9/2003 |
| JP | 2003-319490 | | 11/2003 |
| JP | 2003-319491 | | 11/2003 |
| JP | 2003-332266 | | 11/2003 |
| JP | 2003-343867 | | 12/2003 |
| JP | 20042103 | | 1/2004 |
| JP | 2004-107196 | | 4/2004 |
| JP | 2004229250 | | 8/2004 |
| JP | 2005-20315 | | 1/2005 |
| JP | 2005-51284 | | 2/2005 |
| JP | 2005-73197 | | 3/2005 |
| JP | 2005-97046 | | 4/2005 |
| JP | 2005189322 | | 7/2005 |
| JP | 2005-235672 | | 9/2005 |
| JP | 2005-318040 | | 11/2005 |
| JP | 2005-534515 | | 11/2005 |
| JP | 2005-341554 | | 12/2005 |
| JP | 2005333601 | | 12/2005 |
| JP | 2006-93932 | | 4/2006 |
| JP | 2006-180082 | | 7/2006 |
| JP | 2006-202770 | | 8/2006 |
| JP | 2006-217059 | | 8/2006 |
| JP | 2006270041 | | 10/2006 |
| JP | 2007-24688 | | 2/2007 |
| JP | 2007-54831 | | 3/2007 |
| JP | 2007-167118 | | 7/2007 |
| JP | 2007-174220 | | 7/2007 |
| JP | 2007-187976 | | 7/2007 |
| JP | 2007-196195 | | 8/2007 |
| JP | 2007-228299 | | 9/2007 |
| JP | 2007-527099 | | 9/2007 |
| JP | 2008-62644 | | 3/2008 |
| JP | 2008-101910 | | 5/2008 |
| JP | 2008-153042 | | 7/2008 |
| JP | 2008-163535 | | 7/2008 |
| JP | 2008-269914 | | 11/2008 |
| JP | 2009-31031 | | 2/2009 |
| JP | 2009-91239 | | 4/2009 |
| JP | 2009-94074 | | 4/2009 |
| JP | 2009-146896 | | 7/2009 |
| JP | 2009-146898 | | 7/2009 |
| JP | 2009-164125 | | 7/2009 |
| JP | 2009-184907 | | 8/2009 |
| JP | 2009-184908 | | 8/2009 |
| KR | 10-0761548 | | 9/2007 |
| TW | 432780 | | 5/2001 |
| TW | 568882 | | 1/2004 |
| TW | I248253 | | 1/2006 |
| TW | 200726290 | | 7/2007 |
| TW | 200740976 | | 11/2007 |
| TW | 200744399 | | 12/2007 |
| TW | 200829675 | | 7/2008 |
| TW | 200833862 | | 8/2008 |
| TW | 200950569 | | 12/2009 |
| TW | 201029481 | | 8/2010 |
| WO | WO0073204 | | 12/2000 |
| WO | WO2004012932 | | 2/2004 |
| WO | WO2005102924 | | 11/2005 |
| WO | WO2005120130 | | 12/2005 |
| WO | WO2007043837 | | 4/2007 |
| WO | WO2007049496 | | 5/2007 |
| WO | WO2007052928 | | 5/2007 |
| WO | WO2007099975 | | 9/2007 |
| WO | WO2007111107 | | 10/2007 |
| WO | WO2008/029451 | | 3/2008 |

OTHER PUBLICATIONS

Lina Zhang, Chen Feng, Zhuo Chen, Liang Liu et al., Superaligned Carbon Nanotube Grid for High Resolution Transmission Electron Microscopy of Nanomaterials, Nano Letters, 2008, pp. 2564-2569, vol. 8, No. 8.

William Henry Preece, On Some Thermal Effects of Electric Currents, Proceedings of the Royal Society of London, 1879-1880, pp. 408-411, vol. 30.

H.D. Arnold, I.B. Crandall, The Thermophone as a Precision Source of Sound, Physical Review, 1917, pp. 22-38, vol. 10.

Edward C. Wente, The Thermophone, Physical Review, 1922, pp. 333-345,vol. 19.

Xiaobo Zhang, Kaili Jiang, Chen Feng, Peng Liu et al., Spinning and Processing Continuous Yarns from 4-Inch Wafer Scale Super-Aligned Carbon Nanotube Arrays, Advanced Materials, 2006, pp. 1505-1510, vol. 18.

Kaili Jiang, Qunqing Li, Shoushan Fan, Spinning continuous carbon nanotube yarns, Nature, Oct. 24, 2002, pp. 801, vol. 419.

Strutt John William, Rayleigh Baron, The Theory of Sound, 1926, pp. 226-235, vol. 2.

Kai Liu, Yinghui Sun, Lei Chen, Chen Feng, Xiaofeng Feng, Kaili Jiang et al., Controlled Growth of Super-Aligned Carbon Nanotube Arrays for Spinning Continuous Unidirectional Sheets with Tunable Physical Properties, Nano Letters, 2008, pp. 700-705, vol. 8, No. 2.

Yang Wei, Kaili Jiang, Xiaofeng Feng, Peng Liu et al., Comparative studies of multiwalled carbon nanotube sheets before and after shrinking, Physical Review B, Jul. 25, 2007, vol. 76, 045423.

W. Yi, L.Lu, Zhang Dianlin et al., Linear Specific Heat of Carbon Nanotubes, Physical Review B, Apr. 1, 1999, vol. 59, No. 14, R9015-9018.

Zhuangchun Wu, Zhihong Chen, Xu Du et al.,Transparent, Conductive Carbon Nanotube Films, Science, Aug. 27, 2004, pp. 1273-1276, vol. 305.

J.J. Hopfield, Spectra of Hydrogen, Nitrogen and Oxygen in the Extreme Ultraviolet, Physical Review, 1922, pp. 573-588,vol. 20.

http://www.physorg.com/news123167268.htm.

Mei Zhang, Shaoli Fang, Anvar A. Zakhidov, Sergey B. Lee et al., Strong, Transparent, Multifunctional, Carbon Nanotube Sheets, Science, Aug. 19, 2005, pp. 1215-1219, vol. 309.

Frank P. Incropera, David P. Dewitt et al., Fundamentals of Heat and Mass Transfer, 6th ed., 2007, pp. A-5, Wiley:Asia.

Swift Gregory W., Thermoacoustic Engines and Refrigerators, Physics Today, Jul. 1995, pp. 22-28, vol. 48.

P. De Lange, on Thermophones, Proceedings of the Royal Society of London. Series A, Apr. 1, 1915, pp. 239-241, vol. 91, No. 628.

Braun Ferdinand, Notiz uber Thermophonie, Ann. Der Physik, Apr. 1898, pp. 358-360,vol. 65.

Lin Xiao et al., "Flexible, stretchable, transparent carbon nanotube thin film loudspeakers" vol. 8, No. 12, pp. 4539-4545 ,2008.

Lee et al., Photosensitization of nonlinear scattering and photoacoustic emission from single-walled carbon nanotubes, Applied Physics Letters, 13, Mar. 2008, 92, 103122.

Alexander Graham Bell, Selenium and the Photophone, Nature, Sep. 23, 1880, pp. 500-503.

Silvanus P. Thompson, The Photophone, Nature, 23, Sep. 1880, vol. XXII, No. 569, pp. 481.

Chen, Huxiong; Diebold, Gerald, "Chemical Generation of Acoustic Waves: A Giant Photoacoustic Effect", Nov. 10, 1995, Science, vol. 270, pp. 963-966.
Amos, S.W.; "Principles of Transistor Circuits"; 2000; Newnes-Butterworth-Heinemann; 9th ed.;p. 114.
P.M. Ajayan et al., "Nanotubes in a flash-Ignition and reconstruction", Science, vol. 296, pp. 705, Apr. 26, 2002.
F.Kontomichos et al., "A thermoacoustic device for sound reproduction", acoustics 08 Paris, pp. 4349-4353, Jun. 29-Jul. 4, 2008.
F. Kontomichos et al ., "A thermoacoustic device for sound reproduction", acoustics 08' Paris, Jun. 29-Jul. 4, 2008.

* cited by examiner

THERMOACOUSTIC DEVICE WITH HEAT DISSIPATING STRUCTURE

RELATED APPLICATIONS

This application claims all benefits accruing under 35 U.S.C. §119 from China Patent Application No. 200910189916.5, filed on Aug. 28, 2009 in the China Intellectual Property Office, the disclosure of which is incorporated herein by reference.

BACKGROUND

1. Technical Field

The present disclosure relates to thermoacoustic devices, particularly, to a carbon nanotube based thermoacoustic device with a heating dissipating structure.

2. Description of Related Art

A typical speaker is an electro-acoustic transducer that converts electrical signals into sound. Different types of speakers can be categorized according to their working principles, such as electro-dynamic speakers, electromagnetic speakers, electrostatic speakers and piezoelectric speakers. However, these types use mechanical vibration to produce sound waves by "electro-mechanical-acoustic" conversion. Among the various types, the electro-dynamic speakers are most widely used.

Referring to FIG. 12, the electro-dynamic speaker 500 typically includes a voice coil 502, a magnet 504 and a cone 506. The voice coil 502 is an electrical conductor, and is placed in the magnetic field of the magnet 504. By applying an electrical current to the voice coil 502, a mechanical vibration of the cone 506 is produced due to the interaction between the electromagnetic field produced by the voice coil 502 and the magnetic field of the magnets 504, thus producing sound waves by kinetically pushing the air. The structure of the electric-powered loudspeaker 500 is dependent on magnetic fields and often weighty magnets.

Thermoacoustic effect is the conversion of heat to acoustic signals. When signals are inputted into a thermoacoustic element, heating is produced in the thermoacoustic element according to the variations of the signal and/or signal strength. Heat is propagated into the surrounding medium. The heating of the medium causes thermal expansion and produces pressure waves in the surrounding medium, resulting in sound wave generation. Such an acoustic effect induced by temperature waves is commonly called "the thermoacoustic effect".

A thermophone based on the thermoacoustic effect was created by H. D. Arnold and I. B. Crandall (H. D. Arnold and I. B. Crandall, "The thermophone as a precision source of sound", Phys. Rev. 10, pp 22-38 (1917)). A platinum strip with a thickness of $7\times10^{-5}$ cm was used as a thermoacoustic element. The heat capacity per unit area of the platinum strip with the thickness of $7\times10^{-5}$ cm is $2\times10^{-4}$ J/cm$^2$*K. However, the thermophone adopting the platinum strip produces extremely weak sound.

Carbon nanotubes (CNT) are a novel carbonaceous material having extremely small size and extremely large specific surface area. Carbon nanotubes have received a great deal of interest since the early 1990s, and have interesting and potentially useful electrical and mechanical properties, and have been widely used in a plurality of fields. Fan et al. discloses a thermoacoustic device with simpler structure and smaller size, working without the magnet in an article of "Flexible, Stretchable, Transparent Carbon Nanotube Thin Film Loudspeakers", Fan et al., Nano Letters, Vol. 8 (12), 4539-4545 (2008). The thermoacoustic device includes a sound wave generator which is a carbon nanotube film. The carbon nanotube film used in the thermoacoustic device has a large specific surface area, and extremely small heat capacity per unit area. The sound wave generator emits sound with a wide frequency response range. Accordingly, the thermoacoustic device adopting the carbon nanotube film has a potential to be used in places of the loudspeakers of the prior art.

The carbon nanotube film is soft and can be easily damaged, thus, a base or support is usually adopted to support and protect the carbon nanotube film. However, during operation, the carbon nanotube film will eventually generate heat stored in the base, which may scald a user's hand or may burn anything near the base. The performance of the thermoacoustic device will be adversely affected.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments.

DETAILED DESCRIPTION OF EXEMPLARY EMBODIMENTS

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
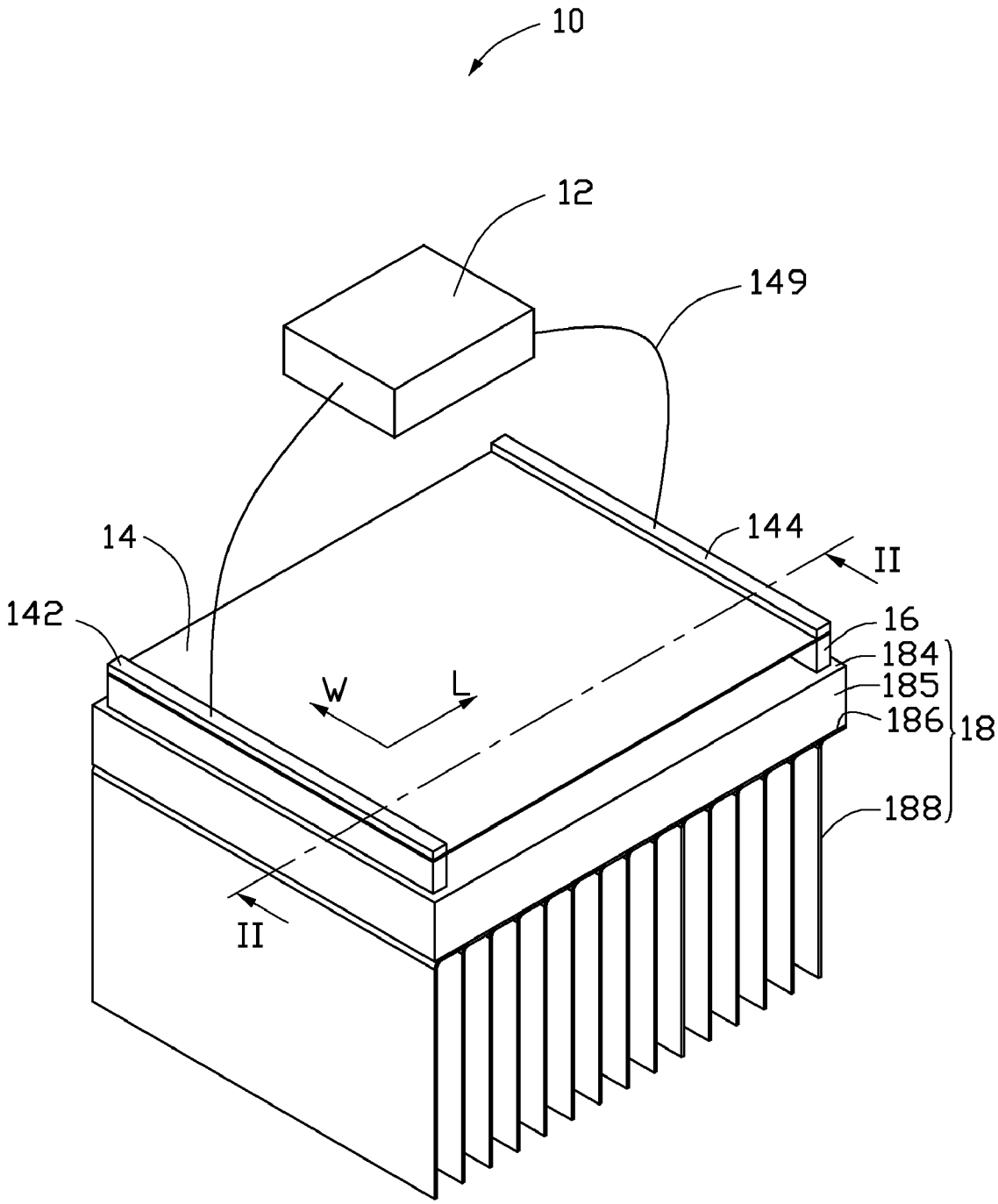
FIG. 1 is a schematic structural view of one embodiment of a thermoacoustic device.
Figure 2:
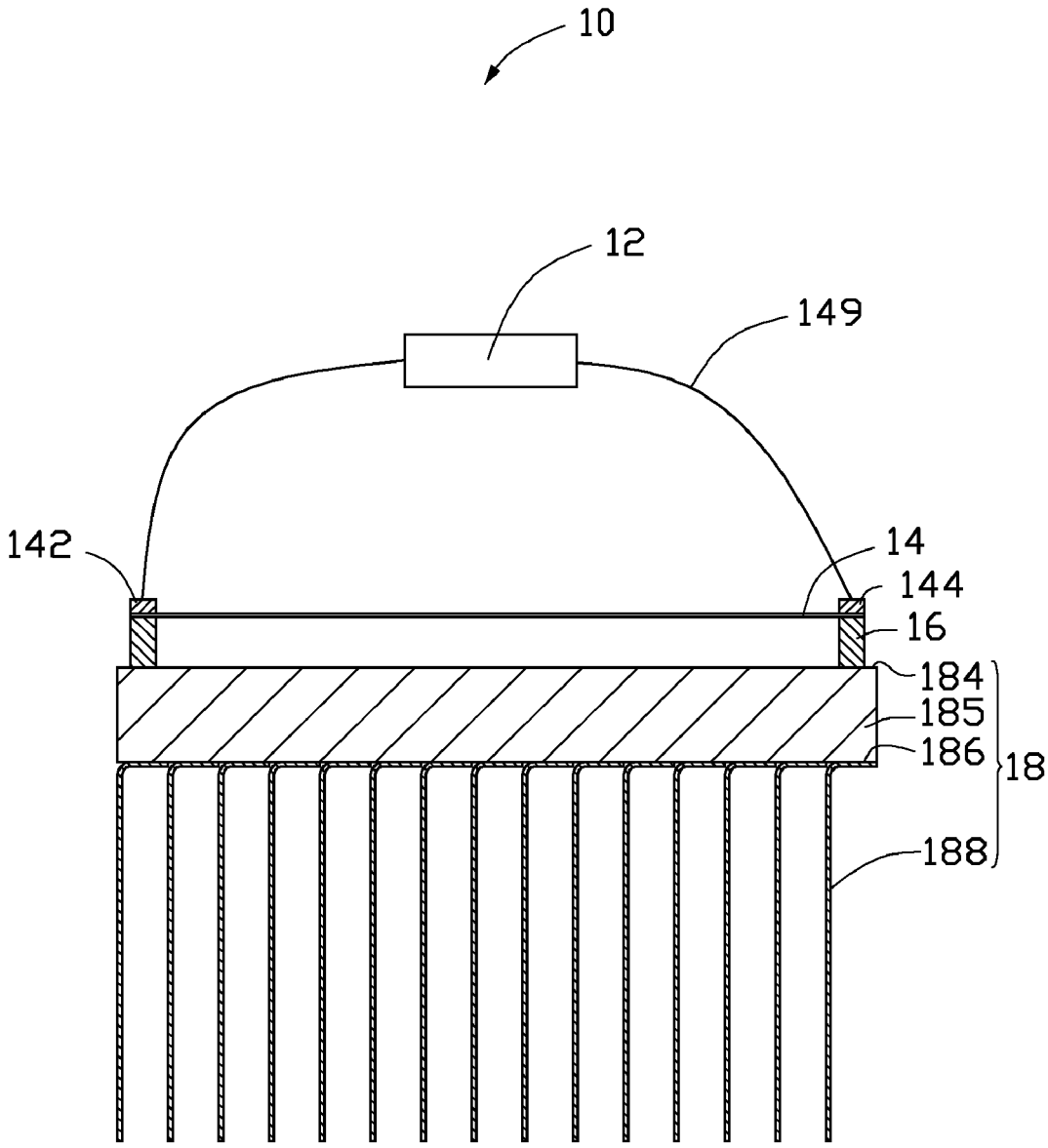
FIG. 2 illustrates a view taken on line II-II of FIG. 1.

One embodiment of a thermoacoustic device 10 is illustrated in FIGS. 1-2. The thermoacoustic device 10 comprises a heat dissipating structure 18, two supporting elements 16, a thermoacoustic element 14, a first electrode 142, a second electrode 144 and a signal input device 12. The thermoacoustic element 14 is disposed on and spaced from the heat dissipating structure 18 through the supporting elements 16. The signal input device 12 is connected with the thermoacoustic element 14 via the first electrode 142 and the second electrode 144.

The heat dissipating structure 18 comprises a base 185 and a plurality of fins 188.

The base 185 can be a flat board, and has a first surface 184 and a second surface 186 opposite to the first surface 184. The base 185 can be made of materials which have good thermal conductivity and have low far-infrared absorption, such as metals including copper and aluminum. The area of the base 185 can be designed according to the actual need so long as the area of the base 185 is not smaller than that of the thermoacoustic element 14. In this embodiment, the base 185 is a copper piece, and has a thickness ranging from about 1 mm to about 5 mm. Both the total cost and thickness of the thermoacoustic device 10 can be lowered due to the relative small thickness of the base 185.

The fins 188 are arranged on the second surface 186, which is the bottom surface of the base 185 when the thermoacoustic device 10 is positioned in the position shown in FIG. 1. The fins 188 are made of thermal conductive materials, such as metals including gold, silver, copper, iron, aluminum and so on. In this embodiment, the fins 188 are copper pieces having a thickness ranging from about 0.5 mm to about 1 mm. The fins 188 can be fixed on the second surface 186 via welding or screws, or other methods. The fins 188 and the base 185 can also be made from one piece of material. The fins 188 can transfer the heat absorbed by the base 185 away and dissipate the absorbed heat to the ambient environment, thereby lowering the temperature of the base 185.

Figure 5:
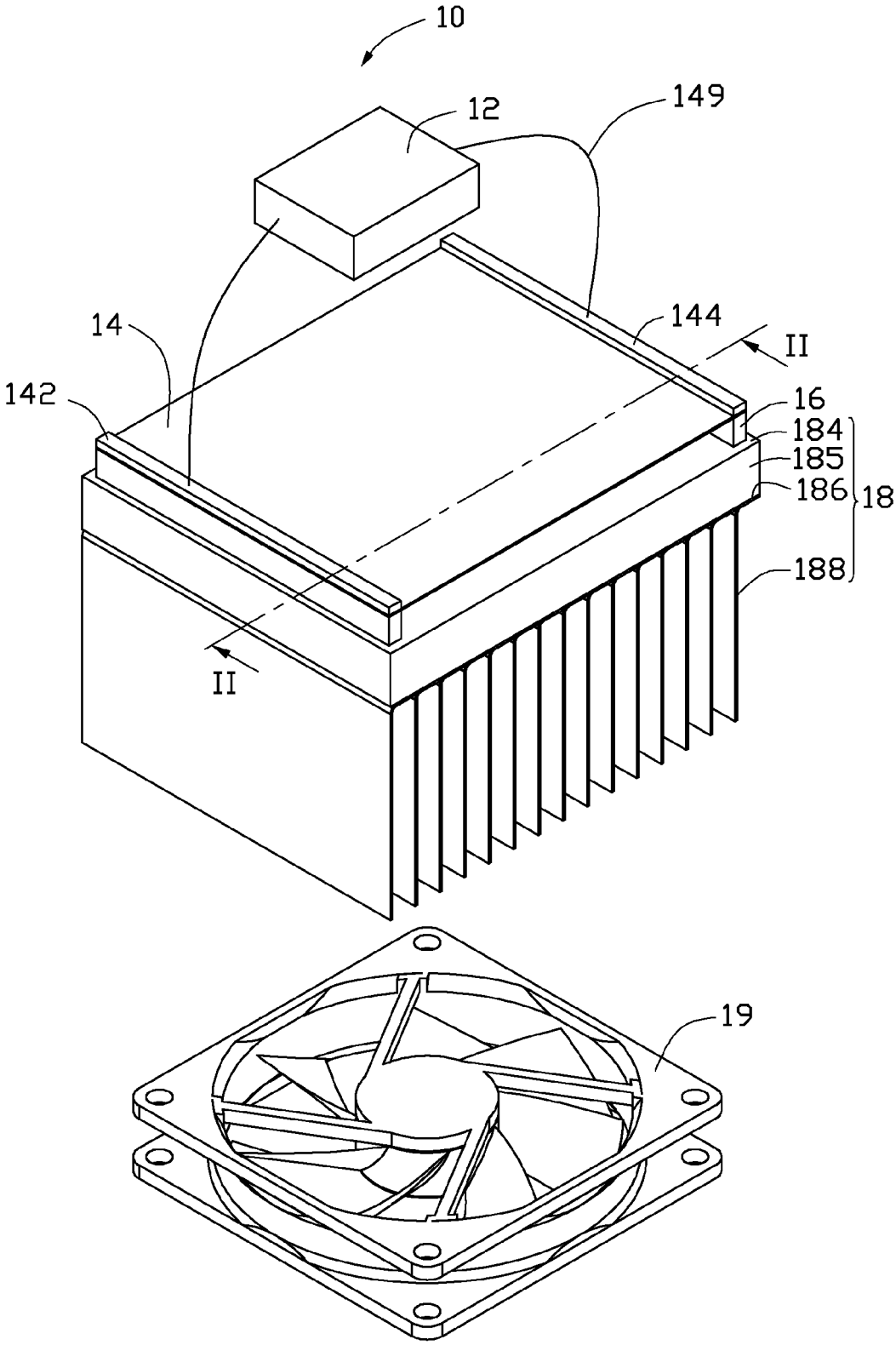
FIG. 5 is similar to FIG. 1, with the addition of a fan.

Referring to FIG. 5, the heat dissipating structure 18 can further comprise a fan 19 mounted on the fins 188. The fan 19 can be secured on the fins 188 via a clip (not shown) or an engagement between the fan 19 and the fins 188. During normal operation, the fan 19 blows air generating airflow towards the fins 188 to take heat therefrom, thus, the heat-dissipation efficiency of the fins 188 can be improved.

The supporting elements 16 are disposed on the first surface 184 and used to support the thermoacoustic element 14 thereon. The supporting elements 16 can be attached to opposite end portions of the first surface 184 via insulating adhesive or screws. The shape of the supporting elements 16 is not limited so long as the supporting elements 16 can support the thermoacoustic element 14 thereon. The supporting elements 16 can be made of materials which are insulative and adiabatic. In one embodiment, the supporting elements 16 are rigid and are made of diamond, glass or quartz. In another embodiment, the supporting elements 16 are flexible and are made of plastic or resin. If the thermoacoustic element 14 has a large area, there can be three or more supporting elements 16 which are disposed on the first surface 184 with a uniform interval formed between adjacent supporting elements 16.

In this embodiment, the supporting elements 16 are strip shaped and made of quartz. A direction from one of the supporting elements 16 to the other one of the supporting elements 16 is defined as a length direction L (shown in FIG. 1) of the thermoacoustic element 14. A direction perpendicular to the length direction L is defined as a width direction W (shown in FIG. 1) of the thermoacoustic element 14 and the supporting elements 16. The width of the supporting elements 16 are designed to be no smaller than the width of the thermoacoustic element 14 so that the thermoacoustic element 14 can be firmly secured on the supporting elements 16.

The thermoacoustic element 14 is disposed on the first surface 184 via the supporting elements 16. The thermoacoustic element 14 is substantially parallel to and spaced from the first surface 184. The thermoacoustic element 14 can be secured on the supporting elements 16 via adhesive. The thermoacoustic element 14 has a low heat capacity per unit area that can realize "electrical-thermal-sound" conversion. The thermoacoustic element 14 can have a large specific surface area to cause pressure oscillations in the surrounding medium by the temperature waves generated by the thermoacoustic element 14. The heat capacity per unit area of the thermoacoustic element 14 can be less than 2×10-4 J/cm$^2$*K. In one embodiment, the thermoacoustic element 14 includes or can be a carbon nanotube structure. The carbon nanotube structure can have a large specific surface area (e.g., above 30 m$^2$/g). The heat capacity per unit area of the carbon nanotube structure is less than 2×10-4 J/cm$^2$*K. In one embodiment, the heat capacity per unit area of the carbon nanotube structure is less than or equal to 1.7×10-6 J/cm$^2$*K.

The carbon nanotube structure can include a plurality of carbon nanotubes uniformly distributed therein, and the carbon nanotubes therein can be joined by van der Waals attractive force therebetween. It is understood that the carbon nanotube structure must include metallic carbon nanotubes. The carbon nanotubes in the carbon nanotube structure can be orderly or disorderly arranged. The term 'disordered carbon nanotube structure' includes, but is not limited to, a structure where the carbon nanotubes are arranged along many different directions, arranged such that the number of carbon nanotubes arranged along each different direction can be almost the same (e.g. uniformly disordered); and/or entangled with each other. 'Ordered carbon nanotube structure' includes, but is not limited to, a structure where the carbon nanotubes are arranged in a systematic manner, e.g., the carbon nanotubes are arranged approximately along a same direction and or have two or more sections within each of which the carbon nanotubes are arranged approximately along a same direction (different sections can have different directions). The carbon nanotubes in the carbon nanotube structure can be selected from single-walled, double-walled, and/or multi-walled carbon nanotubes. Diameters of the single-walled carbon nanotubes range from about 0.5 nanometers to about 50 nanometers. Diameters of the double-walled carbon nanotubes range from about 1 nanometer to about 50 nanometers. Diameters of the multi-walled carbon nanotubes range from about 1.5 nanometers to about 50 nanometers. It is also understood that there may be many layers of ordered and/or disordered carbon nanotube films in the carbon nanotube structure.

The carbon nanotube structure may have a substantially planar structure. The thickness of the carbon nanotube structure may range from about 0.5 nanometers to about 1 millimeter. The smaller the specific surface area of the carbon nanotube structure, the greater the heat capacity per unit area will be. The greater the heat capacity per unit area, the smaller the sound pressure level.

Figure 3:
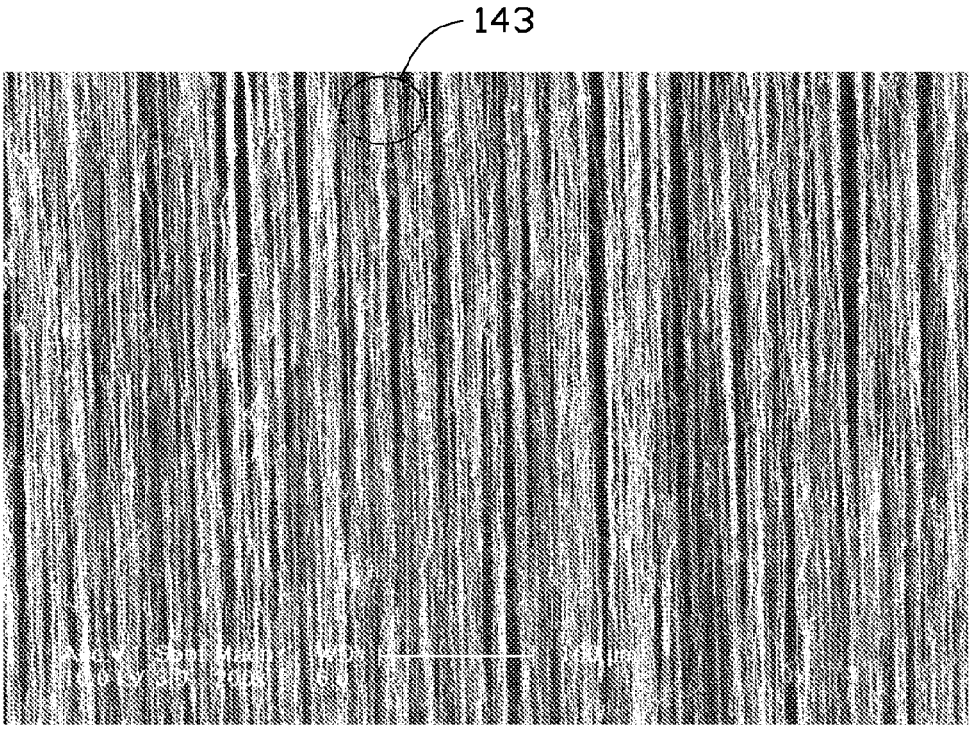
FIG. 3 shows a Scanning Electron Microscope (SEM) image of one embodiment of a drawn carbon nanotube film.
Figure 4:
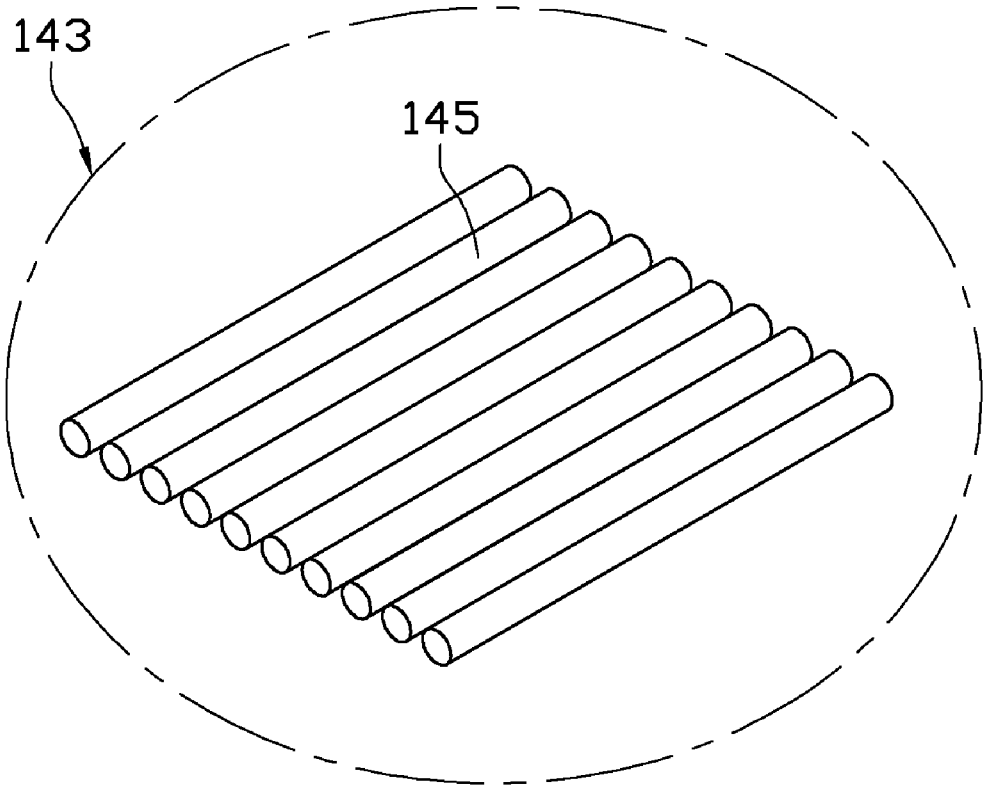
FIG. 4 is a schematic, enlarged view of a carbon nanotube segment in the drawn carbon nanotube film of FIG. 3.

In one embodiment, the carbon nanotube structure can include at least one drawn carbon nanotube film. Examples of a drawn carbon nanotube film are taught by U.S. Pat. No. 7,045,108 to Jiang et al., and WO 2007015710 to Zhang et al. The drawn carbon nanotube film includes a plurality of successive and oriented carbon nanotubes joined end-to-end by van der Waals attractive force therebetween. The carbon nanotubes in the carbon nanotube film can be substantially aligned in a single direction. The drawn carbon nanotube film can be formed by drawing a film from a carbon nanotube array that is capable of having a film drawn therefrom. Referring to FIGS. 3-4, each drawn carbon nanotube film includes a plurality of successively oriented carbon nanotube segments 143 joined end-to-end by van der Waals attractive force therebetween. Each carbon nanotube segment 143 includes a plurality of carbon nanotubes 145 substantially parallel to each other, and joined by van der Waals attractive force therebetween. As can be seen in FIG. 3, some variations can occur in the drawn carbon nanotube film. The carbon nanotubes 145 in the drawn carbon nanotube film are also substantially oriented along a preferred orientation.

The drawn carbon nanotube film also can be treated with an organic solvent. After treatment, the mechanical strength and toughness of the treated drawn carbon nanotube film are increased and the coefficient of friction of the treated drawn carbon nanotube films is reduced. The treated drawn carbon nanotube film has a larger heat capacity per unit area and thus produces less of a thermoacoustic effect than the same film before treatment. A thickness of the drawn carbon nanotube film can range from about 0.5 nanometers to about 100 micrometers.

The carbon nanotube structure of the thermoacoustic element 14 also can include at least two stacked drawn carbon nanotube films. In other embodiments, the carbon nanotube structure can include two or more coplanar drawn carbon nanotube films. Coplanar drawn carbon nanotube films can also be stacked one upon other coplanar films. Additionally, an angle can exist between the orientation of carbon nanotubes in adjacent drawn films, stacked and/or coplanar. Adjacent drawn carbon nanotube films can be combined by only the van der Waals attractive force therebetween without the need of an additional adhesive. The number of the layers of the drawn carbon nanotube films is not limited. However, as the stacked number of the drawn carbon nanotube films increases, the specific surface area of the carbon nanotube structure will decrease. A large enough specific surface area (e.g., above 30 $m^2/g$) must be maintained to achieve an acceptable acoustic volume. An angle between the aligned directions of the carbon nanotubes in the two adjacent drawn carbon nanotube films can range from 0 degrees to about 90 degrees. When the angle between the aligned directions of the carbon nanotubes in adjacent drawn carbon nanotube films is larger than 0 degrees, a microporous structure is defined by the carbon nanotubes in the thermoacoustic element 14. The carbon nanotube structure in one embodiment employing these films will have a plurality of micropores. Stacking the drawn carbon nanotube films will add to the structural integrity of the carbon nanotube structure. In some embodiments, the carbon nanotube structure has a free standing structure and does not require the use of structural support. The term "free-standing" includes, but is not limited to, a structure that does not have to be supported by a substrate and can sustain the weight of itself when it is hoisted by a portion thereof without any significant damage to its structural integrity. The suspended part of the structure will have more sufficient contact with the surrounding medium (e.g., air) to have heat exchange with the surrounding medium from both sides thereof.

Furthermore, the drawn carbon nanotube film and/or the entire carbon nanotube structure can be treated, such as by laser, to improve the light transmittance of the drawn carbon nanotube film or the carbon nanotube structure. For example, the light transmittance of the untreated drawn carbon nanotube film ranges from about 70% to 80%, and after laser treatment, the light transmittance of the untreated drawn carbon nanotube film can be improved to about 95%.

The carbon nanotube structure can be flexible and produce sound while being flexed without any significant variation to the sound produced. The carbon nanotube structure can be tailored or folded into many shapes and put onto a variety of rigid or flexible insulating surfaces, such as on clothing and still produce the same sound quality.

The thermoacoustic element 14 having a carbon nanotube structure comprising of one or more aligned drawn films has another striking property. It is stretchable in a direction perpendicular to the alignment of the carbon nanotubes. The carbon nanotube structure can be stretched to 300% of its original size, and can become more transparent than before stretching. In one embodiment, the carbon nanotube structure adopting one layer drawn carbon nanotube film is stretched to 200% of its original size. The light transmittance of the carbon nanotube structure is about 80% before stretching and can be increased to about 90% after stretching. The sound intensity is almost unvaried during or as a result of the stretching.

The thermoacoustic element 14 is also able to produce sound waves faithfully or properly even when a part of the carbon nanotube structure is punctured and/or torn. If part of the carbon nanotube structure is punctured and/or torn, the carbon nanotube structure is able to produce sound waves faithfully. In contrast, punctures or tears to a vibrating film or a cone of a conventional loudspeaker will greatly affect the performance thereof.

In the embodiment shown in FIGS. 1 and 2, the thermoacoustic element 14 includes a carbon nanotube structure comprising the drawn carbon nanotube film, and the drawn carbon nanotube film includes a plurality of carbon nanotubes arranged along a preferred direction, which is parallel to the length direction L.

The first electrode 142 and the second electrode 144 electrically connect with the thermoacoustic element 14. The first electrode 142 is secured on one end of the thermoacoustic element 14 corresponding to and supported by one of the two supporting elements 16. The second electrode 144 is secured on an opposite end of the thermoacoustic element 14 corresponding to and supported by the other one of the two supporting elements 16. The first electrode 142 and the second electrode 144 are made of electrically conductive materials, such as metals, ITO, conductive glue, or electrical conductive carbon nanotubes. The shape of the first electrode 142 and the second electrode 144 is not limited, and can be layer shaped, rod shaped, block shaped or other shapes. In this embodiment, the first electrode 142 and the second electrode 144 are manufactured by printing two separate layers of electrically conductive slurry on the thermoacoustic element 14.

Further, if the thermoacoustic element 14 is one or more drawn carbon nanotube films, the first electrode 142 and the second electrode 144 can be directly adhered onto the thermoacoustic element 14 due to the adhesive nature of the drawn carbon nanotube films. Moreover, the first electrode 142 and the second electrode 144 can also be adhered onto the thermoacoustic element 14 via conductive adhesives such as conductive silver glues. The conductive adhesive can firmly secure the first electrode 142 and the second electrode 144 to the thermoacoustic element 14.

The signal input device 12 can apply audio signals to the carbon nanotube structure of the thermoacoustic element 14 via the first electrode 142 and the second electrode 144. The signal input device 12 has two outputs connected with the first electrode 142 and the second electrode 144 in a one-to-one manner.

In use, when audio signals, with variations in the application of the signal and/or strength are inputted to the carbon nanotube structure of the thermoacoustic element 14, heat is produced in the carbon nanotube structure according to the variations of the signal and/or signal strength. Temperature waves, which are propagated into surrounding medium, are obtained. The temperature waves produce pressure waves in the surrounding medium, resulting in sound generation. In this process, it is the thermal expansion and contraction of the medium in the vicinity of the thermoacoustic element 14 that produces sound. This is distinct from the mechanism of the conventional loudspeaker, in which the pressure waves are created by the mechanical movement of the diaphragm. Since the input audio signals are electrical signals, the operating principle of the thermoacoustic device 10 is an "electrical-thermal-sound" conversion.

Further, the base 185 will be heated by the heat generated from the carbon nanotube structure of the thermoacoustic element 14 after using the thermoacoustic device 10. The heat accumulated at the base 185 can be dissipated away from the thermoacoustic element 14 by the fins 188. This ensures that the temperature of the base 185 will not scald a user's hand or burn anything near the base 185. A user will be comfortable with the base 185 and the thermoacoustic device 10 even after the thermoacoustic device 10 has been operating for a long period.

Figure 6:
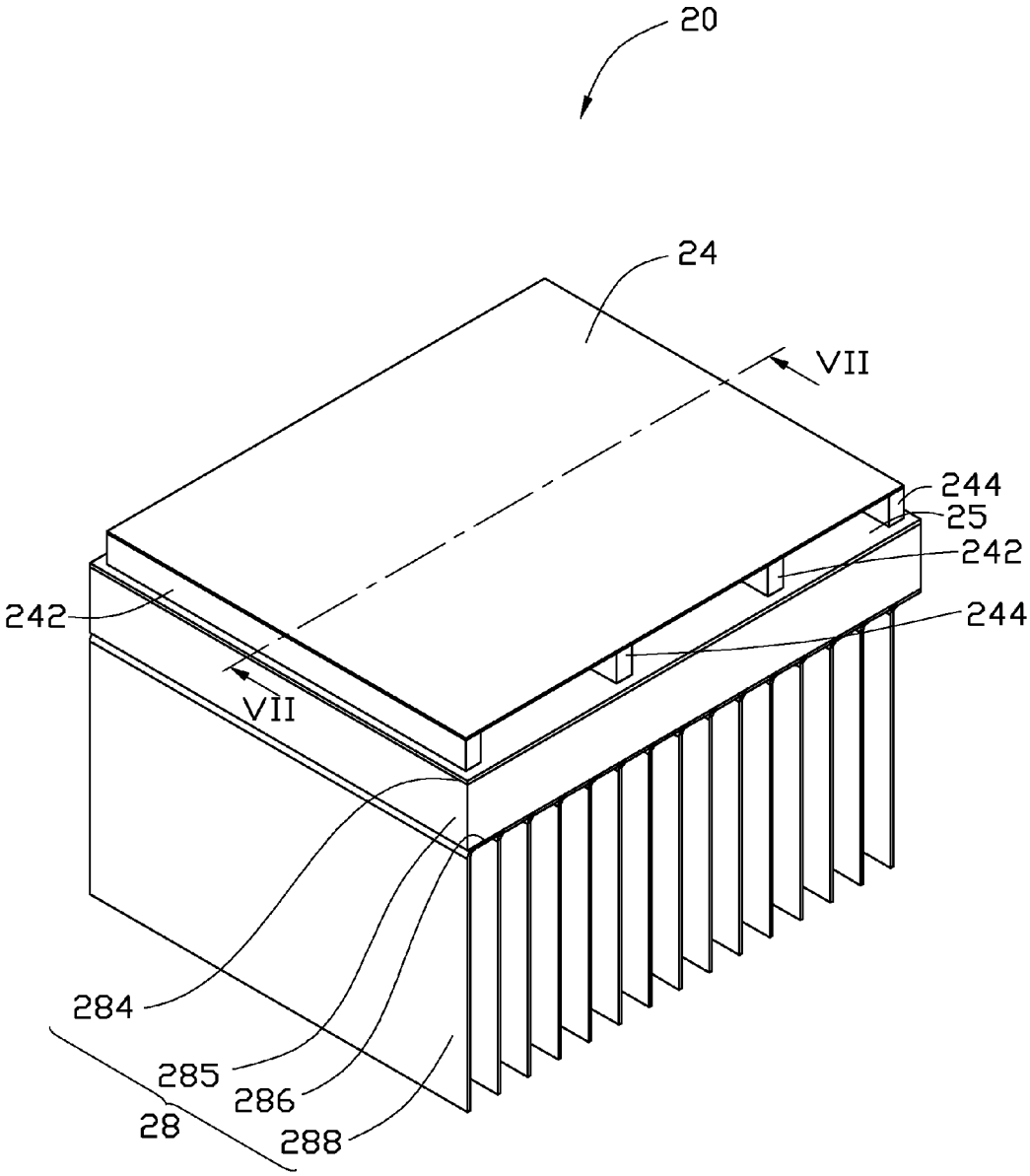
FIG. 6 is a schematic structural view of another embodiment of a thermoacoustic device.
Figure 7:
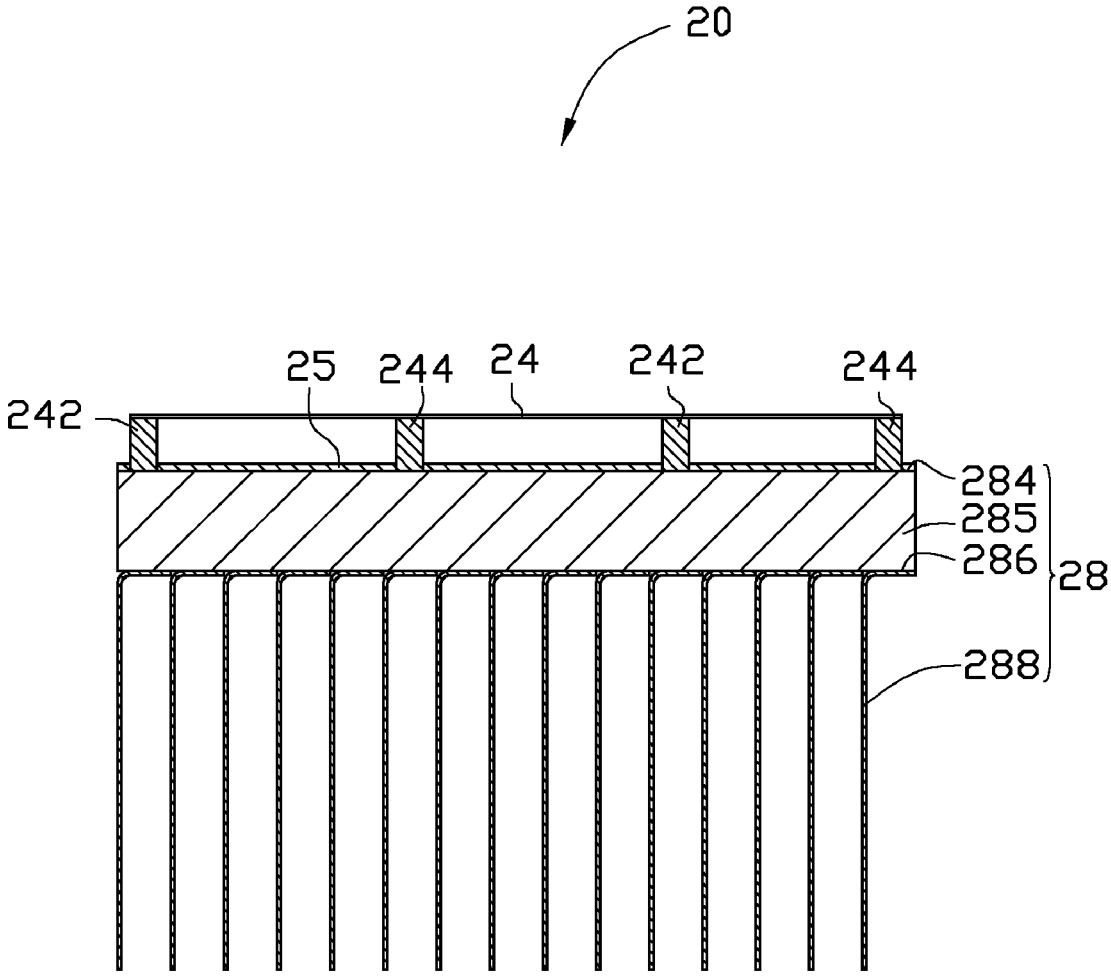
FIG. 7 illustrates a view taken on line VII-VII of FIG. 6.

Referring to the embodiment shown in FIGS. 6-7, a thermoacoustic device 20 comprises a heat dissipating structure 28, a thermoacoustic element 24, a plurality of first electrodes 242, a plurality of second electrodes 244 and a signal input device (not shown). The thermoacoustic element 24 is disposed on the heat dissipating structure 28 through the first electrodes 242 and the second electrodes 244.

The heat dissipating structure 28 comprises a base 285 and a plurality of fins 288.

The base 285 can be a flat board, and has a first surface 284 and a second surface 286 opposite to the first surface 284. The base 285 can be made of electrical insulating materials. In one embodiment, the base 185 is rigid and is made of diamond, glass, ceramic or quartz. The area of the base 285 can be designed according to the actual need so long as the area of the base 285 is not smaller than that of the thermoacoustic element 24. In this embodiment, the base 285 is made of ceramic and has a thickness ranging from about 1 mm to about 5 mm.

The fins 288 are arranged on the second surface 286, which is the bottom surface of the base 285 when the thermoacoustic device 20 is positioned in the position as shown in FIG. 6. The fins 288 are made of thermal conductive materials, such as metals including gold, silver, copper, iron, aluminum and so on. In this embodiment, the fins 288 are copper pieces having a thickness ranging from about 0.5 mm to about 1 mm. The fins 288 can be fixed on the second surface 286 via welding or screws, or other methods. The fins 288 can transfer the heat absorbed by the base 285 away and dissipate the heat to the ambient environment.

The first electrodes 242 and the second electrodes 244 are substantially parallel and alternatively arranged on the first surface 284. The first electrodes 242 and the second electrodes 244 can be attached to the first surface 284 via adhesive or screws. The shape of the first electrodes 242 and the second electrodes 244 is not limited, and can be layer shaped, rod shaped, block shaped or other shapes. The first electrodes 242 and the second electrodes 244 can be made of electrically conductive materials, such as metals including gold, silver, copper, iron, aluminum, ITO, conductive glue, or electrical conductive carbon nanotubes. In this embodiment, the first electrodes 242 and the second electrodes 244 are copper wires which are substantially parallel and spaced arranged on the first surface 284.

The thermoacoustic element 24 is spread on and electrically connects with the first electrodes 242 and the second electrodes 244. The thermoacoustic element 24 is substantially parallel to and spaced from the first surface 284. The thermoacoustic element 24 is the same as the thermoacoustic element 14. In this embodiment, the thermoacoustic element 24 is at least one drawn carbon nanotube film which is spread on the first electrodes 242 and the second electrodes 244. The carbon nanotubes in the drawn carbon nanotube film are oriented along a preferred orientation from the first electrodes 242 to the second electrodes 244.

The signal input device can apply audio signals to the carbon nanotube structure of the thermoacoustic element 24 via the first electrodes 242 and the second electrodes 244. The signal input device has a first end connected with the first electrodes 242 and a second end connected with the second electrodes 144. The first electrodes 242 and the second electrodes 244 are alternatively arranged in parallel, resulting in a parallel connection of portions of the thermoacoustic element 24 between the first electrodes 242 and the second electrodes 244. The parallel connections in the thermoacoustic element 24 provide for lower resistance, thus input voltage required to the thermoacoustic element 24, can be lowered. Additionally, the heat dissipating structure 28 can further comprises a fan (not shown) mounted on the fins 288 in a manner show in FIG. 5.

Further, a heat reflecting layer 25 can be adopted to reduce the amount of heat absorbed by the base 285. As shown in FIG. 6, the heat reflecting layer 25 can be disposed on the first surface 284, and the first electrodes 242 and the second electrodes 244 are then disposed on the heat reflecting layer 25. The heat reflecting layer 25 can be made of white metals, metal compounds, alloy, or other composite materials. For example, the heat reflecting layer 25 can be made of chrome, titanium, zinc, aluminium, gold, silver, aluminium-zinc alloy or coatings including alumina.

When the heat reflecting layer 25 is made of electrically conductive materials, an insulating layer (not shown) may be further provided between the heat reflecting layer 25 and each of the first electrodes 242 and the second electrodes 244. Thus, the first electrodes 242 and the second electrodes 244 are insulated from the heat reflecting layer 25.

Figure 8:
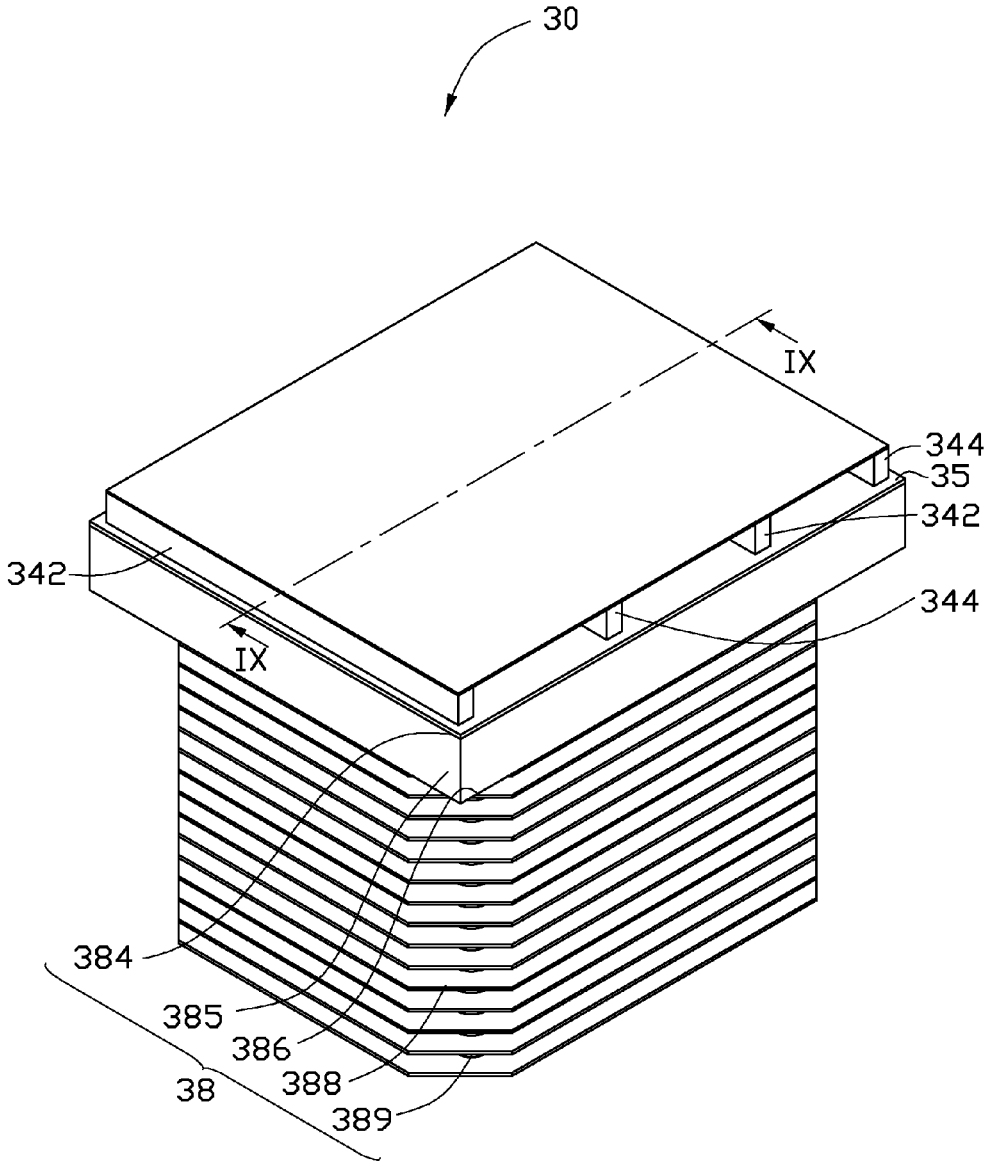
FIG. 8 is a schematic structural view of yet another embodiment of a thermoacoustic device.
Figure 9:
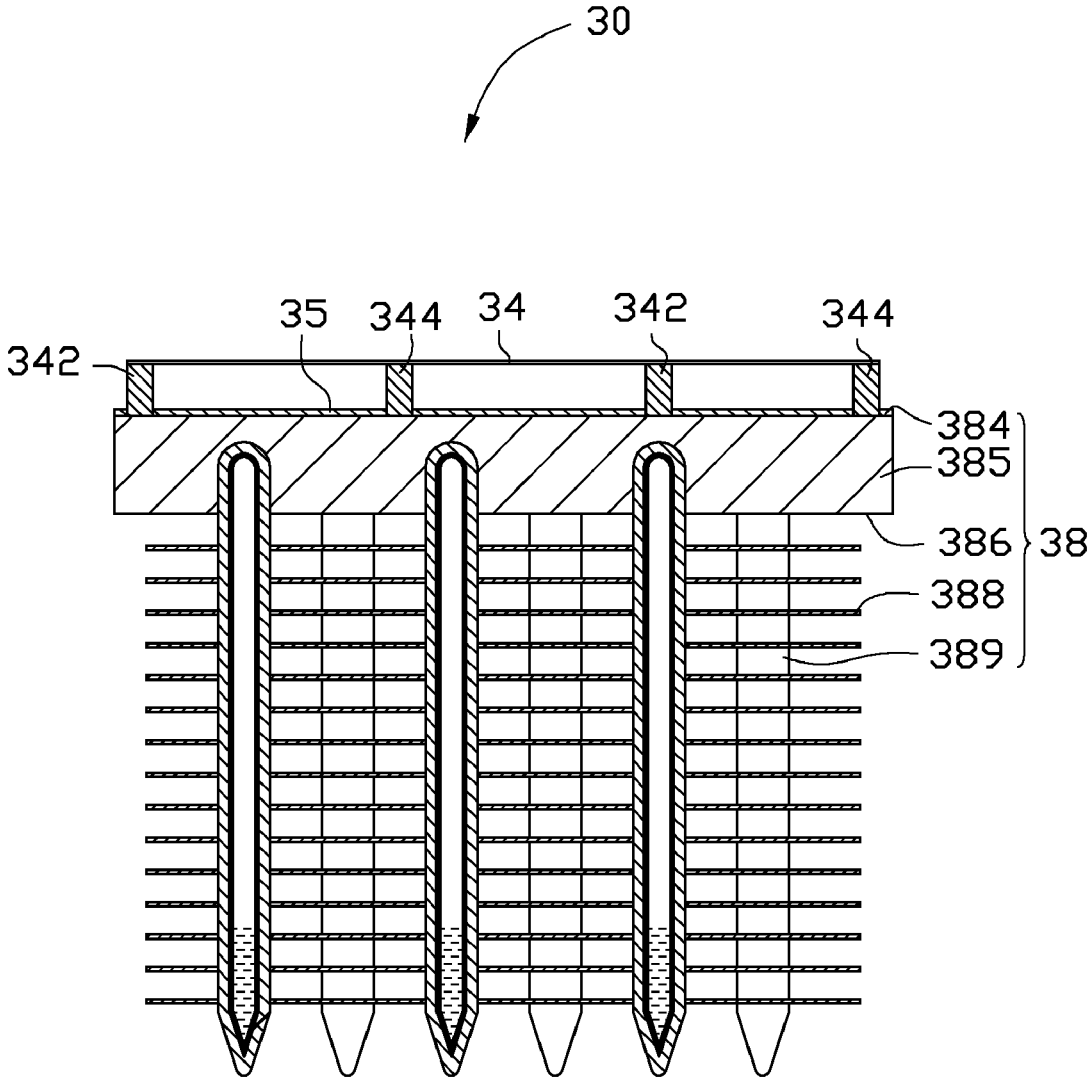
FIG. 9 illustrates a view taken on line IX-IX of FIG. 8.

Referring to the embodiment shown in FIGS. 8-9, a thermoacoustic device 30 is similar to the thermoacoustic device 20. The thermoacoustic device 30 also comprises a heat dissipating structure 38, a heat reflecting layer 35, a thermoacoustic element 34, a plurality of first electrodes 342, a plurality of second electrodes 344 and a signal input device (not shown). However, the heat dissipating structure 38 comprises a plurality of heat pipes 389.

The heat dissipating structure 38 further comprises a base 385 and a plurality of fins 388. The heat pipes 389 thermally connect the base 385 with the fins 388.

The base 385 can be a flat board, and has a first surface 384 and a second surface 386 opposite to the first surface 384. The base 385 can be made of insulative materials. In one embodiment, the base 385 is rigid and is made of diamond, glass, ceramic or quartz. The area of the base 385 can be designed according to the actual need so long as the area of the base 385 is not smaller than that of the thermoacoustic element 34. In this embodiment, the base 385 is made of ceramic and has a thickness ranging from about 1 mm to about 5 mm.

Figure 10:
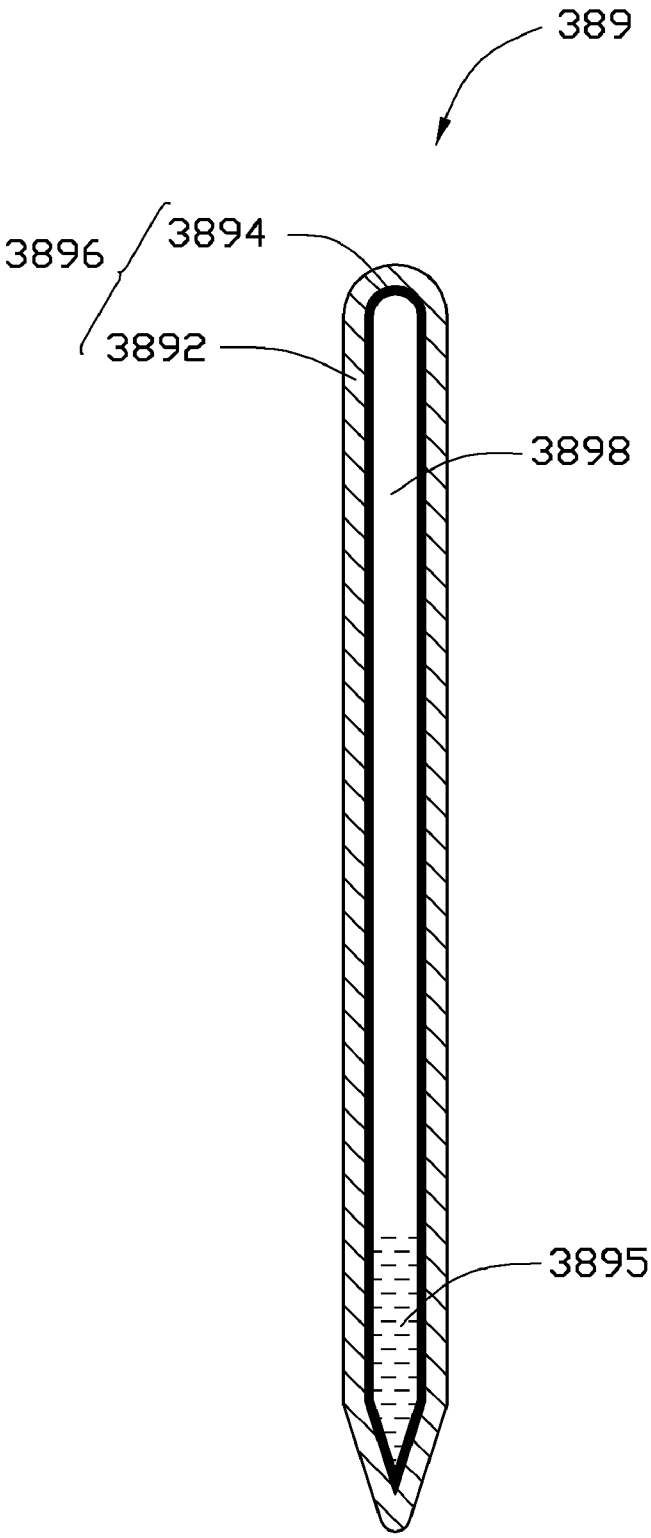
FIG. 10 is an enlarged view of a heat pipe of FIG. 9.
Figure 11:
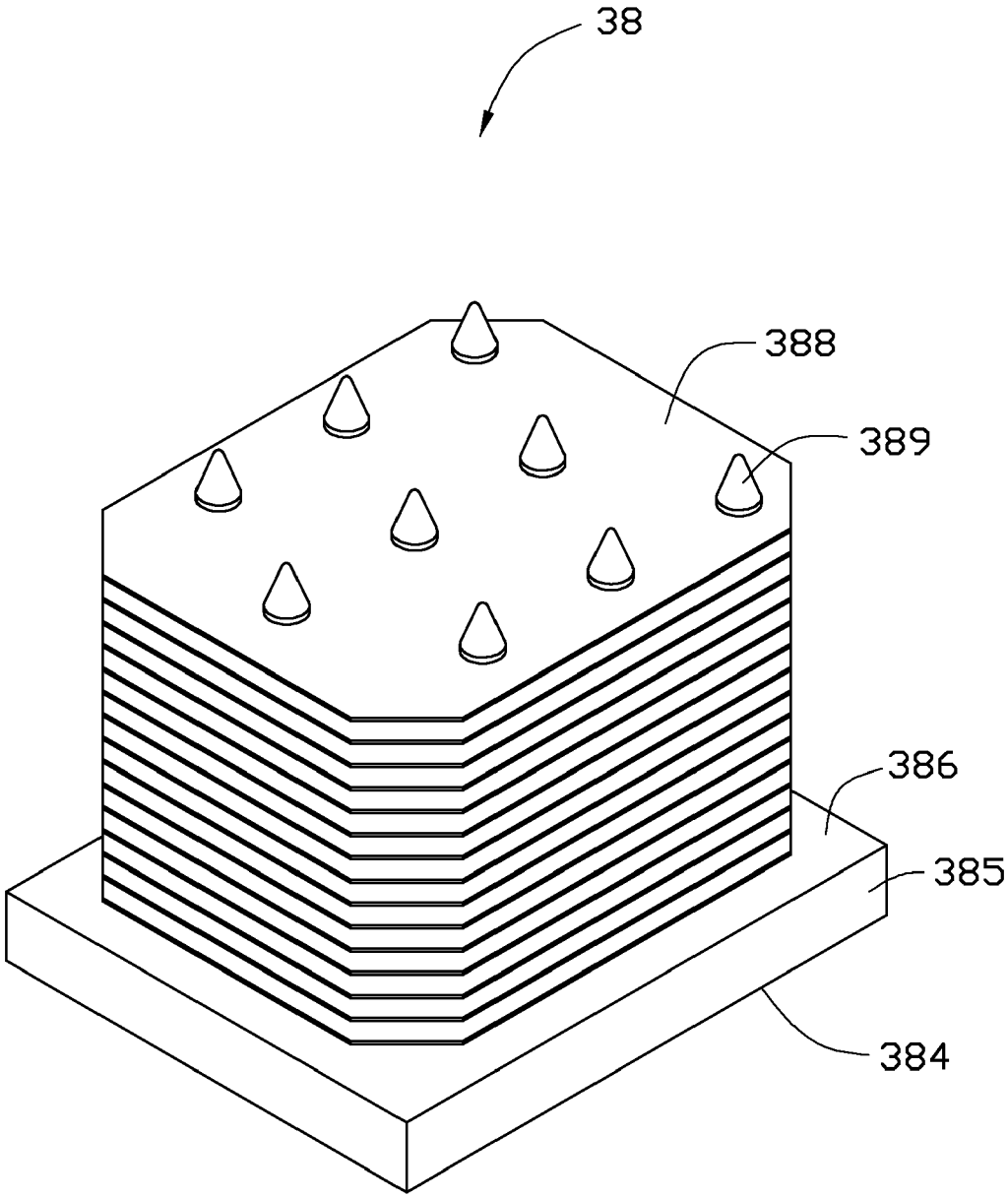
FIG. 11 is similar to FIG. 8, but viewed from another aspect.
Figure 12:
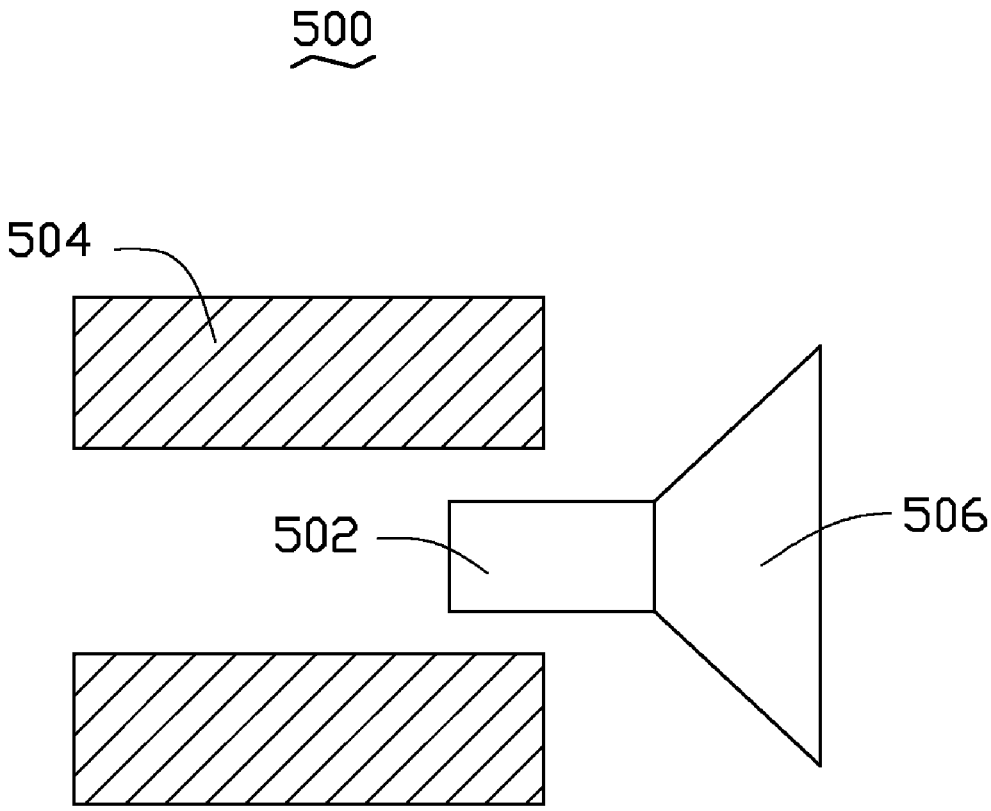
FIG. 12 (PRIOR ART)
FIG. 12 is a schematic structural view of a conventional loudspeaker according to the prior art.

Referring also to the FIG. 10, each of the heat pipes 389 comprises an airtight tubular body 3896, and a quantity of working fluid 3895 contained in a chamber 3898 defined by the body 3896. The working fluid 3895 can be water, ethanol, acetone, sodium, or mercury. The body 3896 comprises an inner wall 3894 and an outer wall 3892. The outer wall 3892 can be made of materials which have high thermal conductivity, such as metals including aluminum, high carbon steel and so on. The inner wall 3894 can be made of materials which have high thermal conductivity and will not chemically react with the working fluid 3895. For example, the inner wall 3894 can be made of copper or nickel. The inner wall 3894 can be plated on an inner surface of the outer wall 3894. A capillary wick (not shown) can be formed on an inner surface of the inner wall 3894.

Each of the heat pipes 389 has a top portion mounted on the base 385 and a bottom portion extending perpendicularly and downwardly from the top portion. The top portion of the heat pipe 389 is also referred to as an evaporator, and the bottom portion of the heat pipe 389 is also referred to as a condenser. The capillary wick generates capillary pressure to transport the working fluid from the condenser to the evaporator.

The fins 388 are mounted on the condensers of the heat pipes 389 via welding or via an interference fit between the heat pipes 389 and the fins 388. The fins 388 are approximately parallel to the second surface 386. The heat pipes 389 extend vertically through the fins 388. The fins 388 are made of thermal conductive materials, such as metals including gold, silver, copper, iron, aluminum and so on. In this embodiment, the fins 388 are copper pieces having a thickness ranging from about 0.5 mm to about 1 mm.

In use, when audio signals, with variations in the application of the signal and/or strength are input applied to the carbon nanotube structure of the thermoacoustic element 34, the thermoacoustic element 34 produces sound. Simultaneously, the base 385 will be heated by the heat generated by the thermoacoustic element 34, and the working fluid 3895 at the evaporators turns into a vapor by absorbing the latent heat of the base 385. The vapor naturally flows through the body 3896, because of the low pressure, and condenses back into a liquid at the condensers, releasing this latent heat. The working liquid 3895 then returns to the evaporators through the capillary action generated by the capillary wick. Thus, the heat accumulated at the base 385 can be quickly transferred to the condensers via phase change of the working fluid 3895. The heat absorbed by the heat pipes 3896 is then dissipated to a place away from the thermoacoustic element 34 via the fins 388. This ensures that the temperature of the base 385 will not scald a user's hand or burn anything near the base 385. A user will be comfortable with the base 385 and the thermoacoustic device 30 even after the thermoacoustic device 30 has been used for a period of time.

Finally, it is to be understood that the above-described embodiments are intended to illustrate rather than limit the present disclosure. Variations may be made to the embodiments without departing from the spirit of the disclosure as claimed. Elements associated with any of the above embodiments are envisioned to be associated with any other embodiments. The above-described embodiments illustrate the scope of the disclosure but do not restrict the scope of the disclosure.

What is claimed is:

1. A thermoacoustic device comprising:

at least one first electrode;

at least one second electrode spaced from the at least one first electrode;

a thermoacoustic element electrically connected with the at least one first electrode and the at least one second electrode, wherein the thermoacoustic element comprises a carbon nanotube structure configured to produce sound waves;

a base supporting the thermoacoustic element and the at least one first electrode and the at least one second electrode; and a plurality of fins in thermal engagement with the base.

2. The thermoacoustic device of claim 1, wherein the base comprises a first surface and an opposite second surface; the thermoacoustic element is disposed on and spaced from the first surface; the fins are in thermal engagement with the second surface.

3. The thermoacoustic device of claim 2, wherein the thermoacoustic element is substantially parallel to the first surface.

4. The thermoacoustic device of claim 2, wherein the at least one first electrode and the at least one second electrode are disposed on the first surface, and the thermoacoustic element is mounted on the at least one first electrode and the at least one second electrode.

5. The thermoacoustic device of claim 4, wherein the base is electrically insulative.

6. The thermoacoustic device of claim 5, wherein the at least one first electrode and the at least one second electrode are directly arranged on the first surface.

7. The thermoacoustic device of claim 5, further comprising a heat reflecting layer disposed on the first surface, wherein the at least one first electrode and the at least one second electrode are disposed on the heat reflecting layer.

8. The thermoacoustic device of claim 7, wherein the heat reflecting layer is electrically conductive, and an insulating layer is provided between the heat reflecting layer and each of the at least one first electrode and the at least one second electrode.

9. The thermoacoustic device of claim 5, wherein the at least one first electrode comprises a plurality of first electrodes and the at least one second electrode comprises a plurality of second electrodes, the first electrodes and the second electrodes being alternatively and spaced arranged on the first surface; the thermoacoustic element is mounted on and electrically connected with the first electrodes and the second electrodes.

10. The thermoacoustic device of claim 9, further comprising a signal input device, wherein the signal input device has a first end connected with the first electrodes and a second end connected with the second electrodes.

11. The thermoacoustic device of claim 5, wherein the fins are vertically arranged on the second surface.

12. The thermoacoustic device of claim 5, further comprising at least one heat pipe comprising an evaporator and a condenser extending from the evaporator, wherein the evaporator of the at least one heat pipe contacts the second surface, and the condenser of the at least one heat pipe contacts the fins.

13. The thermoacoustic device of claim 12, wherein the at least one heat pipe extends into the fins.

14. The thermoacoustic device of claim 13, wherein the fins are approximately parallel to the second surface.

15. The thermoacoustic device of claim 2, further comprising at least two supporting elements disposed on the first surface, wherein the thermoacoustic element is mounted on the at least two supporting elements, and the at least one first electrode and the at least one second electrode are disposed on the thermoacoustic element corresponding to and supported by the at least two supporting elements in a one-to-one manner.

16. The thermoacoustic device of claim 15, wherein the carbon nanotube structure of the thermoacoustic element is one or more drawn carbon nanotube films having adhesiveness, the at least one first electrode and the at least one second electrode being directly adhered onto the thermoacoustic element through the adhesiveness of the drawn carbon nanotube films.

17. The thermoacoustic device of claim 15, wherein the base is electrically conductive.

18. The thermoacoustic device of claim 17, wherein the fins are vertically arranged on the second surface.

19. The thermoacoustic device of claim 14, further comprising a fan mounted on the fins.

20. The thermoacoustic device of claim 1, wherein the carbon nanotube structure comprises at least one drawn carbon nanotube film comprising a plurality of successive and oriented carbon nanotubes joined end-to-end by van der Waals attractive force therebetween, the carbon nanotubes being substantially aligned in a single direction from the at least one first electrode to the at least one second electrode.

* * * * *